US007568594B2

(12) United States Patent
Long

(10) Patent No.: US 7,568,594 B2
(45) Date of Patent: Aug. 4, 2009

(54) OBLONG TISSUE DISPENSER

(75) Inventor: Leslie Thomas Long, Appleton, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 216 days.

(21) Appl. No.: 11/510,399

(22) Filed: Aug. 25, 2006

(65) Prior Publication Data

US 2008/0054012 A1 Mar. 6, 2008

(51) Int. Cl.
*B65H 1/00* (2006.01)

(52) U.S. Cl. ..... 221/63; 221/33

(58) Field of Classification Search ..... 221/33, 221/38, 49, 50, 51, 70, 309
See application file for complete search history.

(56) References Cited

U.S. PATENT DOCUMENTS

| | | | | | |
|---|---|---|---|---|---|
| 2,195,622 | A | | 4/1940 | Fourness et al. | |
| 2,656,916 | A | * | 10/1953 | Henderson | 221/50 |
| 3,369,700 | A | * | 2/1968 | Nelson | 221/63 |
| 3,881,632 | A | * | 5/1975 | Early et al. | 221/50 |
| 4,231,491 | A | * | 11/1980 | Pierson et al. | 221/48 |
| 4,413,769 | A | | 11/1983 | Michetti | |
| 4,765,508 | A | * | 8/1988 | Poppe | 221/48 |
| 5,666,787 | A | * | 9/1997 | Young et al. | 53/438 |
| 5,931,339 | A | * | 8/1999 | Dodge et al. | 221/45 |
| 5,979,700 | A | | 11/1999 | Suess | |
| 5,980,931 | A | | 11/1999 | Fowler et al. | |
| 6,121,165 | A | | 9/2000 | Mackey et al. | |
| 6,202,889 | B1 | * | 3/2001 | Veith | 221/58 |
| 6,213,344 | B1 | * | 4/2001 | Hill | 221/38 |
| 6,213,345 | B1 | * | 4/2001 | Plank | 221/46 |
| 6,543,643 | B2 | * | 4/2003 | Iida et al. | 221/48 |
| 6,672,475 | B1 | * | 1/2004 | Ho et al. | 221/45 |
| D523,669 | S | | 6/2006 | Wieser et al. | |
| 2002/0096533 | A1 | * | 7/2002 | Amundson et al. | 221/63 |
| 2003/0116581 | A1 | * | 6/2003 | Schmidt et al. | 221/49 |
| 2004/0115393 | A1 | * | 6/2004 | Vogel et al. | 428/121 |
| 2004/0169047 | A1 | | 9/2004 | Behnke et al. | |
| 2006/0102642 | A1 | * | 5/2006 | Muntzing et al. | 221/45 |
| 2008/0054012 | A1 | * | 3/2008 | Long | 221/63 |

FOREIGN PATENT DOCUMENTS

DE 1 611 867 B 3/1972

* cited by examiner

*Primary Examiner*—Gene Crawford
*Assistant Examiner*—Kelvin L Randall, Jr.
(74) *Attorney, Agent, or Firm*—Gregory E. Croft

(57) ABSTRACT

An oblong dispenser having a longitudinal axis and a transverse axis, and wherein a maximum length of the dispenser, Ld, along the longitudinal axis is greater than a maximum width of the dispenser, Wd, along the transverse axis. The dispenser containing a plurality of sheets of a sheet-material formed into a flat stack, and the flat stack folded about a transverse fold axis forming an arch-shaped folded stack having an arched stack top and a stack bottom comprising two legs. The arch-shaped folded stack is placed into the oblong dispenser with the transverse fold axis parallel to the oblong dispenser's transverse axis.

16 Claims, 5 Drawing Sheets

OBLONG TISSUE DISPENSER

BACKGROUND

Increasingly, producers of consumer product dispensers, such as facial tissue cartons, are interested in alternative shapes besides the typical parallelepiped shapes generally offered. A parallelepiped (rectangular prism) dispenser shape can offer several advantages such as efficient packing of the product, efficient distribution of the product, and efficient board utilization to make the carton. However, consumers have grown accustomed to such shapes and there is little differentiation from one product to another. Graphical treatments can help, but the basic dispenser shapes are still largely the same for all manufacturers.

A common tissue dispenser is an upright carton having a cubical shape containing an inverted U-shaped, V-folded, interleaved stack of facial tissues. An upright carton typically has a square top and bottom having dimensions of approximately 4.4 inches by 4.4 inches. The height of the upright tissue carton is approximately 5 inches. When this tissue packaging format was first introduced by Kimberly-Clark Corporation many years ago, it was a unique and differentiated packaging format to the traditional flat tissue cartons. As such, it drove consumer interest, enabling Kimberly-Clark Corporation to offer the packaging format as a premium product. Patent protection for the upright tissue carton and the tissue stack folding method has expired, enabling many other manufacturers to enter the market.

Alternatively shaped tissue dispensers to the ubiquitous flat or upright tissue cartons could offer an advantage in product differentiation. Alternatively shaped tissue dispensers could be offered as a new premium product and upright tissue dispensers as a mid-tier product. However, alternatively shaped dispensers are typically not as well suited to the size of standard tissue stacks, which often fit better and dispense better from the traditional shapes. This can significantly reduce the number of sheets that can fit into the alternatively shaped dispenser and/or cause dispensing problems (sheet tears, multiple dispensing, sheet fallback) when dispensing. Dispensing problems can cause a perception of poor quality in the mind of the user/purchaser making it more difficult to position an alternatively shaped dispenser as a premium product.

Therefore, a need exists for dispenser shapes that are significantly differentiated from existing upright or flat tissue carton shapes; yet, at the same time, can dispense tissue stacks as well or better than current upright or flat dispensers for a similar sheet count tissue stack.

SUMMARY

The inventors have discovered that by forming a sheet-material dispenser into an oblong shape and then loading an oblong, inverted arch-shaped folded stack of sheets into the dispenser with the fold axis of the stack aligned with the transverse axis of the dispenser, an alternatively shaped dispenser can have reliable dispensing characteristics. In one embodiment, the dispenser was an oval tissue carton and an inverted arched-shaped stack of Z-folded interleaved facial tissue sheets was placed into the dispenser.

Hence, in one aspect, the invention resides in a product including: an oblong dispenser having a longitudinal axis and a transverse axis, and wherein a maximum length of the dispenser, Ld, along the longitudinal axis is greater than a maximum width of the dispenser, Wd, along the transverse axis, the dispenser containing a plurality of sheets of a sheet-material; the plurality of sheets formed into a flat stack, and the flat stack folded about a transverse fold axis forming an arch-shaped folded stack having an arched stack top and a stack bottom comprising two legs; and the arch-shaped folded stack placed into the oblong dispenser with the transverse fold axis parallel to the oblong dispenser's transverse axis.

BRIEF DESCRIPTION OF THE DRAWINGS

The above aspects and other features, aspects, and advantages of the present invention will become better understood with regard to the following description, appended claims, and accompanying drawings in which:

Figure 1:
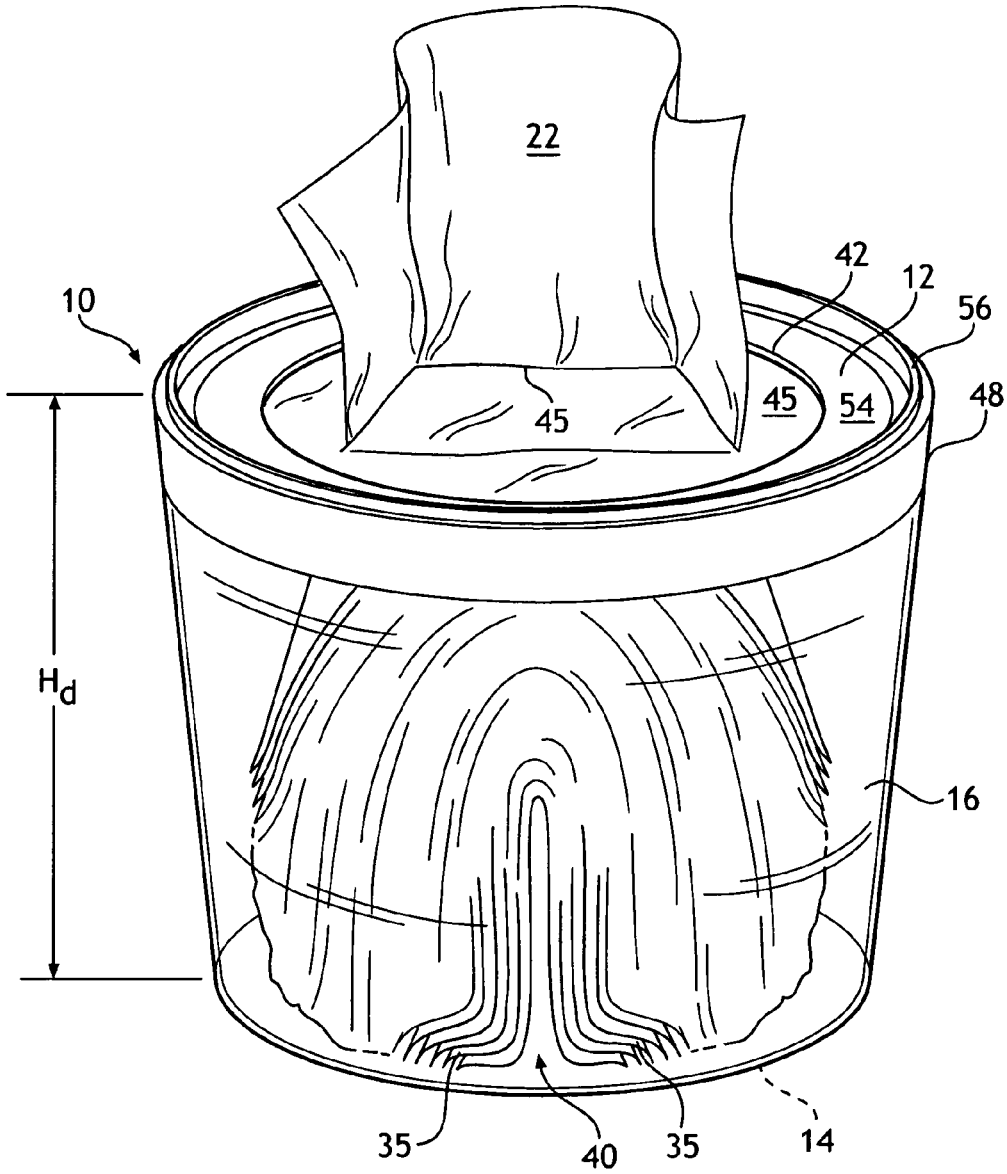
FIG. 1 is a perspective view showing one embodiment of the sheet-material dispenser of the present invention.

Repeated use of reference characters in the specification and drawings is intended to represent the same or analogous features or elements of the invention in different embodiments.

DEFINITIONS

As used herein, forms of the words "comprise", "have", and "include" are legally equivalent and open-ended. Therefore, additional non-recited elements, functions, steps or limitations may be present in addition to the recited elements, functions, steps, or limitations.

As used herein, "sheet-material" is a flexible substrate, which is useful for household chores, cleaning, personal care, health care, food wrapping, and cosmetic application or removal. Non-limiting examples of suitable substrates for use with the dispenser include nonwoven substrates; woven substrates; hydro-entangled substrates; air-entangled substrates; paper substrates comprising cellulose such as tissue paper, toilet paper, or paper towels; waxed paper substrates; coform substrates comprising cellulose fibers and polymer fibers; wet substrates such as wet wipes, moist cleaning wipes, moist toilet paper wipes, and baby wipes; film or plastic substrates such as those used to wrap food; and shop towels. Furthermore, laminated or plied together substrates of two or more layers of any of the preceding substrates are also suitable.

As used herein, "wet sheet-material" includes substrates that are either wet or pre-moistened by an appropriate liquid, partially moistened by an appropriate liquid, or substrates that are initially dry but intended to be moistened prior to use by placing the substrate into an appropriate liquid such as water or a solvent. Non-limiting examples of suitable wet substrates include a substantially dry substrate (less than 10% by weight of water) containing lathering surfactants and conditioning agents either impregnated into or applied to the substrate such that wetting of the substrate with water prior to use yields a personal cleansing product. Such substrates are disclosed in U.S. Pat. No. 5,980,931 entitled Cleansing Products Having A Substantially Dry Substrate, issued to Fowler et al. on Nov. 9, 1999. Other suitable wet sheet-materials can have encapsulated ingredients such that the capsules rupture during dispensing or use. Other suitable wet sheet-materials include dry substrates that deliver liquid when subjected to in-use shear and compressive forces. Such substrates are disclosed in U.S. Pat. No. 6,121,165 entitled Wet-Like Cleaning Articles, issued to Mackay et al. on Sep. 19, 2000.

As used herein a "U-shaped stack" is a V-folded interleaved stack of sheets formed from a sheet-material assembled into a flat stack that is subsequently folded 180 degrees about a transverse fold axis such that the final overall shape of the U-shaped stack measures approximately the same in the maximum length and the maximum width.

As used herein, an "arch-shaped stack" is a folded stack of sheets formed from a sheet-material assembled into a flat stack that is subsequently folded 180 degrees or less about a transverse fold axis such that the final overall shape of the arch-shaped stack has a maximum width dimension, Wf, which is less than the maximum length dimension, Lf, as measured with the arch-shaped folded stack inserted into the oblong dispenser.

DETAILED DESCRIPTION

It is to be understood by one of ordinary skill in the art that the present discussion is a description of exemplary embodiments only, and is not intended as limiting the broader aspects of the present invention, which broader aspects are embodied in the exemplary construction.

Figure 2:
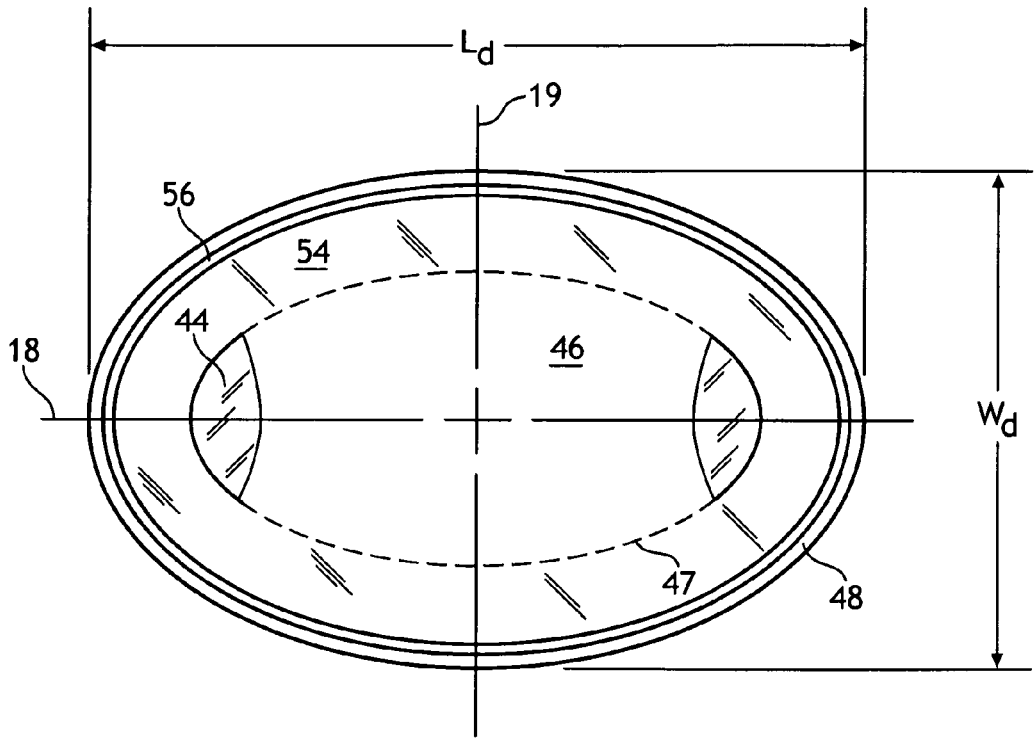
FIG. 2 is a top view of FIG. 1 prior to opening the sheet-material dispenser.
Figure 3:
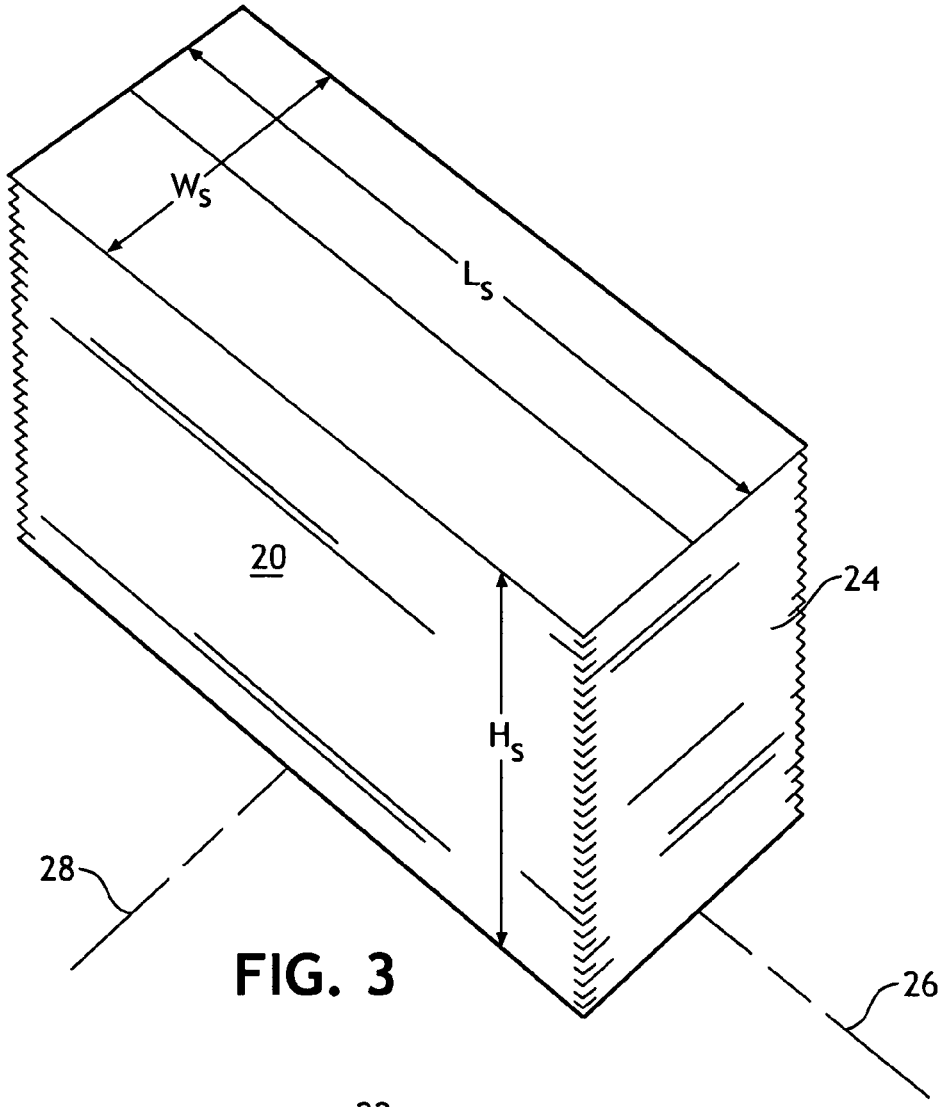
FIG. 3 is a perspective view of a stack containing a plurality of sheets formed from a sheet-material.
Figure 3A:
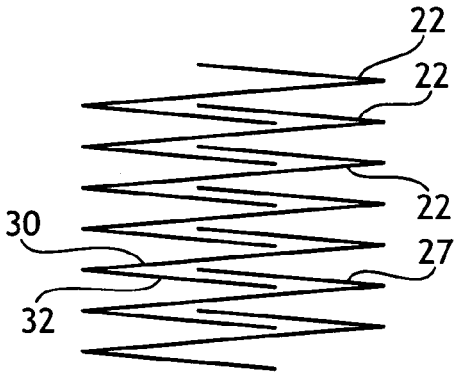
FIG. 3A is a partially exploded end view of the stack of FIG. 3 showing one embodiment of a fold configuration for the plurality of sheets.
Figure 3B:
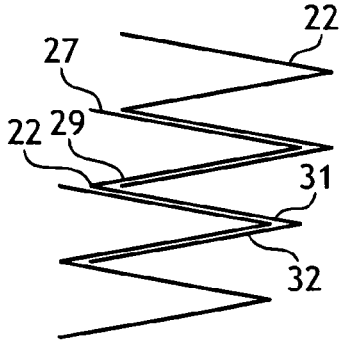
FIG. 3B is a partially exploded end view of the stack of FIG. 3 showing one embodiment of a fold configuration for the plurality of sheets.

Referring now to FIGS. 1 and 2, one embodiment of an oblong dispenser 10 is illustrated. The dispenser includes a top 12, a bottom 14, and a sidewall 16. The dispenser has a maximum length, Ld, measured along a longitudinal axis 18, and a maximum width, Wd, measured along a transverse axis 19. The dispenser is oblong with the dimension for Ld greater than the dimension for Wd. As used herein, "maximum" for a length, width, or height dimension is used to refer the greatest dimension of the object in that specific direction if the shape of the object is such that it has a variable length, width, or height from the use of curved or tapered portions, for example. Maximum does not mean that the dimension referred to may not exceed a given dimension. Another embodiment of the object may have a different maximum length, width, or height.

In one embodiment, the top and the bottom (12, 14) comprised an oval shape and the dispenser had a maximum length, Ld, of 5 and ⅞ inches and a maximum width, Wd, of 3 and ⅞ inches. This oval sheet material dispenser is visually striking and an alternatively shaped dispenser to the square or rectangular facial tissue boxes currently offered. The dispenser in FIG. 1 is shown as having a transparent sidewall 16 to see the sheet-material within the dispenser. In various embodiments of the invention, all or a portion of the dispenser can be transparent, translucent, opaque, or combinations thereof.

Referring now to FIGS. 3, 3A, 3B, and 4, a flat stack 20 of a plurality of individual sheets 22 formed from a sheet-material 24 is illustrated. The flat stack 20 has a maximum length, Ls, measured along a longitudinal axis 26, and a maximum width, Ws, measured along a transverse fold axis 28. In one embodiment, the flat stack 20 contained discrete, individual tissue paper sheets that are Z-folded and interleaved such that a portion of a leading panel 27 of the next sheet in the flat stack 20 is placed between a center panel 30 and a trailing panel 32 of the preceding sheet. Such a configuration enables pop-up dispensing where withdrawing one sheet from the dispenser pulls at least a portion of the next sheet out of the dispenser for easier access to the next sheet.

In another embodiment, the flat stack can contain discrete sheets that are W-folded and interleaved such that the leading panel 27 and a first center panel 29 of a subsequent sheet are placed between a second center panel 31 and the trailing panel 32 of the preceding sheet. Such a configuration enables pop-up dispensing. It is believed that interleaving both the leading panel 27 and the first center panel 29 with the preceding sheet can provide for more reliable pop-up dispensing because more surface area of the sheets are in contact to prevent fallback when the dispenser is nearly empty and/or to reduce sheet tears since the user can grasp a doubled portion of the sheet when dispensing each sheet.

After assembling the flat stack 20, it is folded up to 180 degrees about the transverse fold axis 28 to form an arch-shaped folded stack 34 having an arched-stack top 36 and a stack bottom comprising two opposing legs 38 located on opposite sides of the transverse fold axis 28 and extending there from. The arch-shaped folded stack 34 is then inserted into the oblong dispenser 10 such that the transverse fold axis 28 is substantially parallel to the dispenser's transverse axis 19. As best seen by comparing FIGS. 4 and 1, this results in the arch-shaped folded stack 34 filling out the length and width of the oblong dispenser 10 without the arch-shaped folded stack 34 being unduly compressed by the oblong dispenser's sidewall 16. As such, improved dispensing occurs and the oblong dispenser 10 is able to hold more sheets than if the stack is inserted into the oblong dispenser 10 with the transverse fold axis parallel to the dispenser's longitudinal axis 18.

Figure 4:
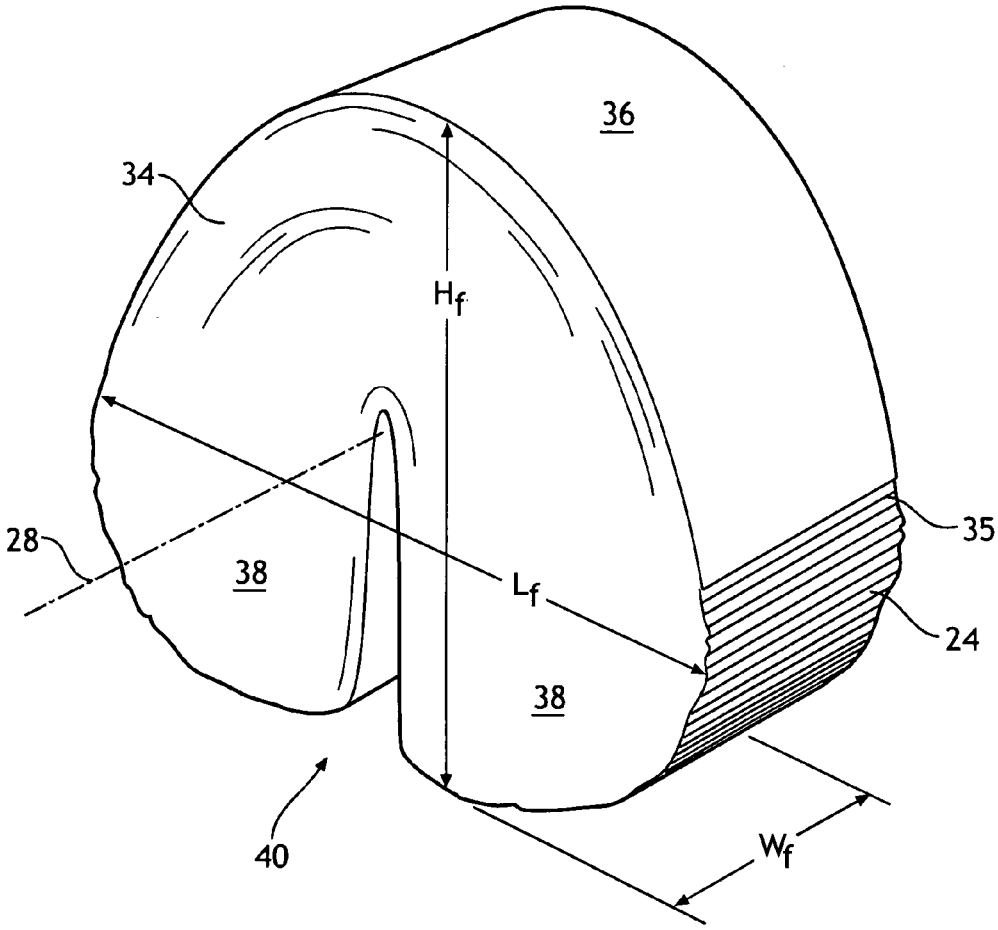
FIG. 4 is a perspective view of the stack of FIG. 3 folded about a transverse fold axis into an inverted arch-shaped folded stack.

The arch-shaped folded stack 34 is rotated 90 degrees about a Z-axis, when compared to an existing upright facial tissue dispenser, such that the longitudinal axis 26 of the arch-shaped folded stack 34 is aligned with the longitudinal axis 18 of the oblong dispenser 10 before inserting the arch-shaped folded stack 34 into the oblong dispenser 10. As a result, the legs 38 of the arch-shaped folded stack 34 are far less likely to be significantly compressed by the oblong dispenser's sidewall 16. In fact, depending on how much the arch-shaped folded stack 34 is required to be folded about the transverse fold axis 28 to fit into the oblong dispenser 10, the sheet edges 35 of the uppermost sheets in the arch-shaped folded stack 34 may end significantly above the arch-shaped folded stack's bottom as best seen in FIG. 4. As such, only a small portion of the length, Ls, of the upper sheets in the arch-shaped folded stack 34 touch the oblong dispenser's sidewall 16. This can significantly reduce the force needed to dispense the first sheet, reducing or eliminating sheet tears To make a U-shaped stack, a flat tissue stack 20 containing approximately 100 two-ply facial tissue sheets are V-folded and interleaved for pop-up dispensing. In one embodiment, the flat stack has a length, Ls, of approximately 8.4 inches, a width, Ws, of approximately 4.5 inches, and a height, Hs, of approximately 1.5 inches prior to folding the flat stack about the transverse fold axis 28. The aspect ratio of the flat stack's height to its width, Hs/Ws, is approximately 0.33. In order for the flat stack 20 to be folded into a U-shape, the aspect ratio for Hs/Ws must be 0.5 or less since twice the height of the stack, Hs, must be less than the width of the stack, Ws, in order for the folded length of the stack, Lf, to be equal to or less than the folded width, Wf. Over time and during handling, the tissue stack height, Hs, may increase from the initial height after being subjected to compressive forces during tissue converting which increases the folded length, Lf.

When the flat stack described above is folded 180 degrees about the transverse fold axis 28 into a U-shape for insertion into an upright tissue carton, it assumes a substantially square overall shape having a folded height, Hf, of approximately 4.5 inches, a folded width, Wf, of approximately 4.5 inches, and a folded length, Lf, of approximately 4.5 inches. When the U-shaped stack is placed into a standard upright carton (4.4 inches by 4.4 inches by 5 inches high) the sides of the U-shaped folded stack are only slightly compressed and the upright carton readily dispenses the interleaved tissue sheets.

However, if the same U-shaped folded facial tissue stack is placed into the oblong dispenser 10 of FIG. 1 with the transverse fold axis 28 parallel to the longitudinal dispenser axis 18 (longitudinal axis of the stack aligned with the transverse axis of the dispenser), the U-shaped folded stack can be compressed too much for reliable dispensing. This is believed to occur because the oval oblong dispenser 10, in one embodiment, has a maximum width, Wd, of 3 and ⅞ inches that tapers significantly toward the sides of the dispenser. As such, the U-shaped folded stack having a folded length, Lf, of approximately 4.5 inches is significantly compressed by the dispenser's sidewall 16; especially, at the edges of the U-shaped folded stack that are located adjacent to the portions of the sidewall 16 having a smaller radii. This can result in a large number of the initial sheets within the stack being torn as they are dispensed. A possible solution is to reduce the number of sheets in the U-shaped folded stack to relieve the compression, but often this is not acceptable since users of the product desire a high sheet count product that lasts longer.

To better utilize the interior volume of the oblong dispenser 10, an innovative solution is to fold the individual sheets of the flat stack 20 such that when the flat stack is assembled, it has a smaller maximum width, Ws. The flat stack 20 is then folded about the transverse fold axis 28 into an arch-shaped folded stack 34 having an arch-shape stack width, Wf, less than the arch-shaped stack length, Lf. The arch-shaped folded stack 34 is orientated within the oblong dispenser 10 rotated approximately 90 degrees such that the transverse fold axis 28 is substantially parallel to the dispenser's transverse axis 19. Improved dispensing is believed to occur since the individual sheets 22 within the arch-shaped folded stack 34 are subjected to less compression by the interior of the oblong dispenser 10, resulting in fewer torn sheets during dispensing. The legs 38 of the arch-shaped folded stack 34 are pinched less or not at all by the sidewall of the oblong dispenser 10.

One method to assemble the flat stack 20 such that it has a smaller folded width, Ws, is to Z-fold the sheets (resulting in three panels separated by two fold lines per sheet), or W-fold the sheets (resulting in four panels separated by three fold lines per sheet) in an interleaved manner rather than V-folding the sheets (resulting in two panels separated by a fold line). After folding the flat stack 20 about the transverse fold axis 28 into an arch-shaped folded stack 34, the arch-shaped folded stack is oblong, having a maximum folded width, Wf, which is less than the maximum folded length, Lf, as best seen in FIG. 4. The prior art U-shaped folded stack has approximately the same folded width, length, and height as discussed above.

As best seen in FIG. 4, the sheets in the uppermost layers of the arch-shaped folded stack 34 forming the arched top 36 do not extend completely down the sidewall 16 of the oblong dispenser 10 since the arch-shaped folded stack 34 can have a greater radius of curvature (folded less than 180 degrees about the transverse fold axis) at the arched top 36 than the prior art U-shaped stack placed into an upright tissue carton. The sheet edges 35 of the uppermost sheets in the arch-shaped folded stack 34 may end significantly above the arch-shaped folded stack's bottom. As such, only a small portion of the length, Ls, of the upper sheets in the arch-shaped folded stack 34 may touch the oblong dispenser's sidewall 16. Therefore, the uppermost sheets in the arch-shaped folded stack 34 may not be compressed much, if at all, by the oblong dispenser's sidewall 16. Since these are the initial sheets withdrawn from the oblong dispenser 10 and since they are relatively free of contact with the dispenser's sidewall, the drag or frictional force to remove them from the oblong dispenser 10 is greatly reduced. As such, improved dispensing of the initial sheets occurs. In general, the arch-shaped folded stack 34 will be folded less than 180 degrees about the transverse fold axis since the maximum length of the dispenser, Ld, can be chosen to minimize compression of the legs 38 within the arch-shaped folded stack 34.

The inventor has discovered, surprisingly, that even though the maximum height of the flat stack 20, Hs, is significantly increased by Z-folding the sheets instead of V-folding the sheets for the same number of sheets, the resulting height of the arch-shaped folded stack 34, Hf, is not significantly increased. This is believed to occur since the sheets near a middle portion 40 of the arch-shaped folded stack 34 do not have sufficient rigidity to support the weight of the upper sheets in the arch-shaped folded stack without bending. As such, the sheets near the middle portion 40 of the arch-shaped folded stack 34 tend to be bent approximately 90 degrees such that a portion of the sheet adjacent the free end 35 lies parallel to the dispenser's bottom 14 as best seen in FIG. 1. This reduces the maximum height, Hf, of the arch-shaped folded stack 34. As such, the maximum height of the dispenser, Hd, can be the same or less than the maximum height of an upright tissue dispenser when using the same length sheets, Ls.

Secondly, the arched top 36 of the arch-shaped folded stack 34 can have a greater radius of curvature from being folded less than 180 degrees about the transverse fold axis 28 resulting in the maximum height, Hf, of the arch-shaped folded stack to be reduced. Finally, the inventor believes that compressing the stack to reduce the maximum height, Hf, of the arch-shaped folded stack 34 to fit into a shorter dispenser 10 by folding or compressing the sheets near the bottom of the arch-shaped folded stack 34 is not as detrimental to sheet dispensing as compressing the sides of the arch-shaped folded stack 34 to reduce the maximum length, Lf. The lower sheets in the arch-shaped folded stack 34 are believed to incur more of the compression, which is quickly reduced once the upper sheets are dispensed. As such, improved dispensing can occur by maintaining or reducing the maximum height, Hd, of the dispenser and increasing its maximum length, Ld.

In one embodiment, 100 two-ply facial tissue sheets are Z-folded and assembled into a flat stack 20 having a maximum length, Ls, of approximately 8.4 inches, a maximum width, Ws, of approximately 2.9 inches, and a maximum height, Hs, of approximately 2.25 inches. The aspect ratio of the flat stack's height to its width, Hs/Ws, was approximately 0.78. The flat stack 20 was then folded about the transverse fold axis 28 to form an arch-shaped folded stack 34 having a maximum length, Lf, of approximately 5.0 inches, a maximum width, Wf, of approximately 2.9 inches and a maximum height, Hf, of approximately 4.7 inches. The arch-shaped folded stack 34 was placed into the oblong oval dispenser 34 illustrated in FIG. 1 having a maximum height, Hd, of approximately 5.0 inches; a maximum length, Ld, of approximately 5.9 inches; and a maximum width, Ws, of approximately 3.9 inches. Thus, even though the height, Hs, of the flat stack 20 of 100 Z-folded sheets measured approximately 2.25 inches, which is 0.75 inches greater than the 100 sheet count V-folded flat stack discussed above, the arch-shaped folded stack 34 was easily inserted into the oblong dispenser 10 having a maximum height, Hd, of approximately 5.0 inches which is identical to existing upright facial tissue dispensers. Furthermore, the tissue sheets dispensed as good as or better than existing upright cartons containing 100 two-ply facial tissue sheets, which was an unexpected result.

Figure 5:
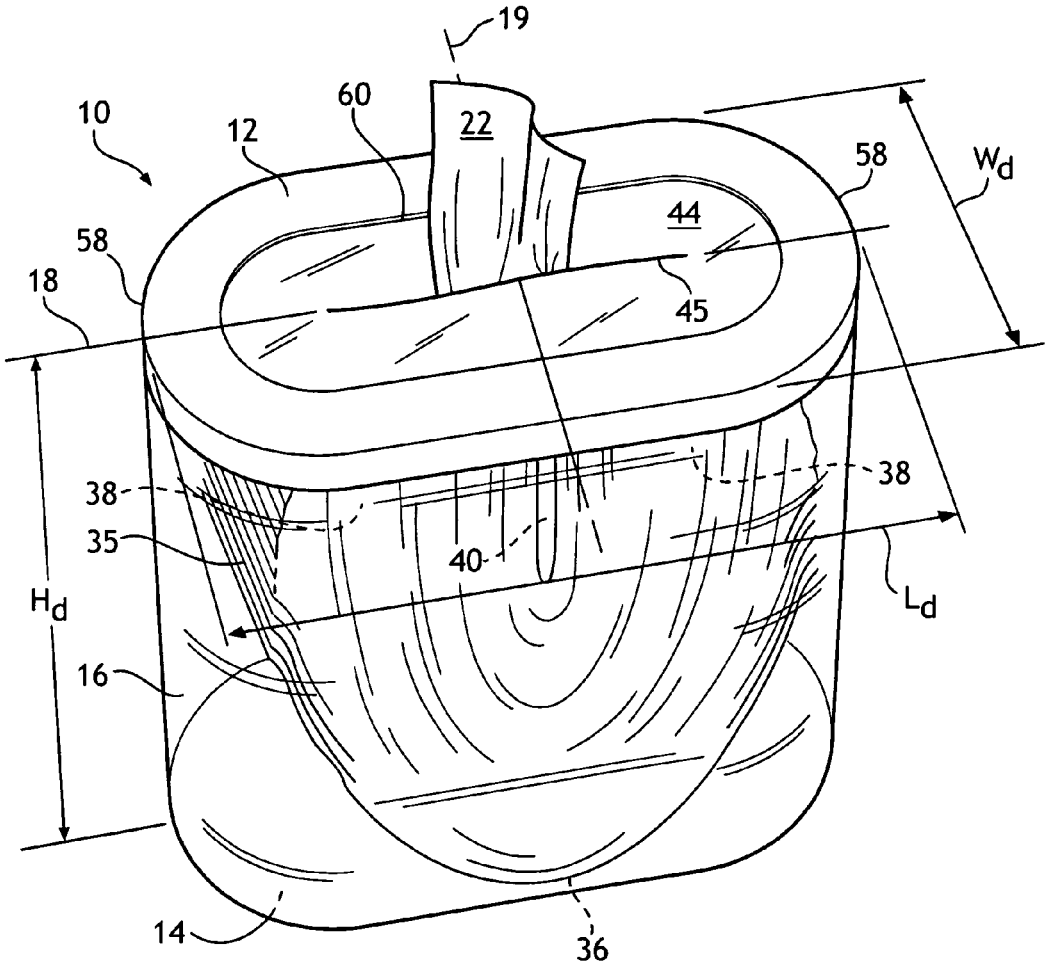
FIG. 5 is a perspective view showing another embodiment of the sheet-material dispenser of the present invention.

Referring now to FIG. 5, another embodiment of the oblong dispenser 10 and arch-shaped folded stack 34 is shown. In this embodiment, the top and the bottom (12, 14) of the oblong dispenser 10 includes a pair of opposing curved ends 58 and a pair of opposing linear sides 60 resulting in a racetrack profile similar to a stockcar track or speed skating rink. In this embodiment, the arch-shaped folded stack 34 is inserted into the dispenser with the arched top 36 adjacent to the dispenser's bottom 14. As such, the sheets 22 are dispensed from the middle portion 40 of the arch-shaped folded stack 34. In various embodiments of the invention, the oblong dispenser's sidewall 16 can be oval, racetrack, rectangular, or another polygon shape.

Referring back to FIGS. 1 and 2, the oblong dispenser 10 can further include a dispensing opening 42 normally located in the top 12, but the dispensing opening can be optionally located in the sidewall 16 or the bottom 14. The dispensing opening 42 can optionally include a dispensing window 44. The dispensing window 44 can be made from a suitable material such as a film, nonwoven, or paper material that can retain a partially dispensed sheet 22, such as a facial tissue, within the dispensing opening 42 for pop-up dispensing. The dispensing window 44 can have a dispensing orifice 45 that can be a slit; a curvilinear line; a geometric shape such as an oval, a circle, or a triangle; or X-shaped, †-shaped or H-shaped orifice. Alternatively, the dispensing window 44 can be eliminated and fingers or tabs projecting into the dispensing opening 42 can be used to retain a partially dispensed sheet 22.

The dispensing opening 42 can be any size or shape such as square, circular, or oval. The dispensing opening generally will be larger in size for a reach-in dispenser and smaller in size for a pop-up dispenser. The oblong dispenser 10 can further include an optional removable surfboard or cover 46 that can be attached to the dispenser 10 by a perforated or weakened line 47. The removable cover 46 can be used to prevent foreign materials from entering the filled dispenser and provides protection for the more fragile dispensing window 44 during loading and shipping. The oblong dispenser 10 can also include an optional film wrapper to further cover the dispensing opening 42 or outer portion of the dispenser. The film wrapper can be used to display printed information, such as a prominent trademark, size of the sheets, the number of sheets, or patent information, which can later be removed by the user so as to not detract from the graphic design of the dispenser.

The dispenser can be made from suitable materials that include, without limitation, cardboard, carton stock, paper board, polypropylene, polyethylene, polystyrene, ABS plastic, plastic, metal, wood, and glass, amongst other suitable alternatives.

In one embodiment, the oblong dispenser 10 included a formed oval sidewall 16 and bottom 14 made from carton stock or paperboard. The bottom 14 can be either recessed or even with the sidewall 16. The upper end of the sidewall 16 was folded over on the inside of the dispenser 10 to form an edge or lip. The dispenser 10 included a snap-in top 12, having an outer ring 48 formed from a plastic material that is molded around a paperboard center portion 54 containing the dispensing opening 42, optional dispensing window 44, and optional removable cover 46. A flange on the outer ring 48 engages with the edge or lip on the interior of the sidewall 16 to secure the top 12 in place. If desired, the outer ring 48 can include a stacking lip 56 for use with a recessed bottom 14 to nest or interlock vertically stacked dispensers.

Alternative methods of constructing the oblong dispenser 10 can be used. For example, a carton blank or tube can be utilized. The carton blank can comprise a plurality of panels that are folded, assembled, and glued together to form a dispenser. A tube with plugs or caps can be used to construct the dispenser. Injection molding or thermoforming can be used to form the dispenser. Other techniques known to those of skill in the art can be utilized to make the oblong dispenser 10.

In various embodiments of the invention, the arch-shaped folded stack 34 is placed in the oblong dispenser with the transverse fold axis parallel to the oblong dispenser's transverse axis. For this orientation, the percentage of the maximum dispenser length, Ld to the maximum flat stack 20 length, Ls, can be between about 55% to about 80% percent, or between about 60% to about 75%, or between about 60% to about 70% to minimize the compression of the arch-shaped folded stack 34 by the oblong dispenser's sidewall 16. In the embodiment previously described for 100 two-ply Z-folded facial tissue sheets, the percentage of the maximum dispenser length, Ld to the maximum flat stack 20 length, Ls, was 5.8/8.4*100=69%.

As discussed prior art, U-shaped folded stacks are formed from flat stacks with an aspect ratio, Hs/Ws, that is less than 0.50. In various embodiments of the invention, the aspect ratio of the flat stack's height to its width, Hs/Ws, for forming the arch-shaped folded stack 34 was greater than about 0.50 or between about 0.55 to about 0.9, or between about 0.6 to about 0.85, or between about 0.7 to about 0.8 in order to form an oblong, arch-shaped folded stack as opposed to a cubical, U-shaped stack. In the embodiment previously described for 100 two-ply Z-folded facial tissue sheets, the aspect ratio of the flat stack's height to its width, Hs/Ws, for forming the arch-shaped folded stack 34 was 2.25/2.9=0.78.

Other modifications and variations to the present invention may be practiced by those of ordinary skill in the art, without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

I claim:

1. A product comprising:

an oblong dispenser having a longitudinal axis and a transverse axis, and wherein a maximum length of the dispenser, Ld, along the longitudinal axis is greater than a maximum width of the dispenser, Wd, along the transverse axis, the dispenser containing a plurality of sheets of a sheet-material;

the plurality of sheets formed into a flat stack having a maximum flat stack length, Ls, and the flat stack folded about a transverse fold axis forming an arch shaped folded stack having an arched stack top and a stack bottom comprising two legs, wherein an aspect ratio of the flat stack's maximum height to its maximum width, Hs/Ws, prior to folding the flat stack about the transverse fold axis is greater than about 0.5 and wherein the ratio of the maximum dispenser length, Ld to the maximum flat stack length, Ls, as a percentage, is between about 55% to about 80%; and the arch-shaped folded stack placed into the oblong dispenser with the transverse fold axis parallel to the oblong dispenser's transverse axis.

2. The product of claim 1 wherein the dispenser comprises a top having a dispensing opening, a bottom, and a sidewall; and the top and bottom both comprise an oval shape.

3. The product of claim 1 wherein the dispenser comprises a top having a dispensing opening, a bottom, and a sidewall; and the top and the bottom comprising a pair of opposing curved ends and a pair of opposing linear sides.

4. The product of claim 1 wherein the dispenser comprises a top having a dispensing opening, a bottom, and a sidewall, and the arched stack top is located adjacent to the dispensing opening in the top.

5. The product of claim 1 wherein the dispenser comprises a top having a dispensing opening, a bottom, and a sidewall, and the arched stack top is located adjacent to the dispenser's bottom.

6. The product of claim 1 wherein the flat stack comprises a plurality of discrete sheets that are Z-folded and interleaved for pop-up dispensing.

7. The product of claim 1 wherein the flat stack comprises a plurality of discrete sheets that are W-folded and interleaved for pop-up dispensing.

8. The product of claim 7 wherein the W-folded sheets comprise a leading panel, a first center panel, a second center panel, and a trailing panel; and wherein the leading panel and the first center panel are interleaved between the second center panel and the trailing panel of a preceding sheet.

9. A product comprising:

a dispenser having a maximum dispenser length, Ld, said dispenser housing an arch-shaped folded stack containing a plurality of sheets formed from a sheet-material, wherein the arch-shaped folded stack is formed from a flat stack having a maximum length, Ls, a maximum height, Hs, a maximum width, Ws, wherein the aspect ratio of the maximum height to the maximum width, Hs/Ws, is between about 0.55 to about 0.9 and wherein the ratio of the maximum dispenser length, Ld, to the maximum flat stack length, Ls, as a percentage, is between about 55% to about 80%;

the arch-shaped folded stack having a maximum folded stack width, Wf, and a maximum folded stack length, Lf; and wherein Lf is greater than Wf.

10. The product of claim 9 wherein the dispenser comprises a top having a dispensing opening, a bottom, and a sidewall, and the top and the bottom comprise an oval.

11. The product of claim 9 wherein the aspect ratio of the maximum height to the maximum width, Hs/Ws, is between about 0.7 to about 0.8.

12. The product of claim 9 wherein the ratio of the maximum dispenser length, Ld, to the maximum flat stack length, Ls, as a percentage, is between about 60% to about 75%.

13. The product of claim 9 wherein the ratio of the maximum dispenser length, Ld, to the maximum flat stack length, Ls, as a percentage, is between about 60% to about 70%.

14. The product of claim 9 wherein the sheet-material comprises paper and the arch-shaped folded stack is formed from a flat stack comprising the plurality of sheets that are Z-folded and interleaved.

15. The product of claim 9 wherein the sheet-material comprises paper and the arch-shaped folded stack is formed from a flat stack comprising the plurality of sheets that are W-folded and interleaved.

16. The product of claim 15 wherein the W-folded sheets comprise a leading panel, a first center panel, a second center panel, and a trailing panel; and wherein the leading panel and the first center panel are interleaved between the second center panel and the trailing panel of a preceding sheet.

* * * * *